United States Patent [19]

Leeds et al.

[11] Patent Number: 4,709,971

[45] Date of Patent: Dec. 1, 1987

[54] COMPUTER WORK STATION

[75] Inventors: Richard Leeds, Lawrence; Arthur Roberts, Westbury, both of N.Y.

[73] Assignee: Global Equipment Company, Hempstead, N.Y.

[21] Appl. No.: 796,802

[22] Filed: Nov. 12, 1985

[51] Int. Cl.[4] ..... A47B 21/03

[52] U.S. Cl. ..... 312/201; 312/240; 312/282

[58] Field of Search ..... 312/194, 195, 196, 282, 312/240, 241, 313, 208, 209, 198, 199, 201; 108/77, 78, 80; 190/9-11, 12 A, 12 R; 211/26

[56] References Cited

U.S. PATENT DOCUMENTS

| | | | |
|---|---|---|---|
| 349,875 | 9/1886 | Crocker | 312/240 |
| 1,075,541 | 10/1913 | Browne | 248/65 X |
| 1,858,146 | 5/1932 | Ferguson | 312/209 |
| 2,672,921 | 3/1954 | Herrick | 190/12 R |
| 2,856,252 | 10/1958 | Herring | 312/194 |
| 3,220,679 | 11/1965 | Larson | 248/74.5 X |
| 3,263,947 | 8/1966 | Kettunen | 248/74.5 X |
| 3,292,886 | 12/1966 | Rovinsky | 248/74.5 X |
| 4,258,963 | 3/1981 | Fusselman et al. | 312/194 |

*Primary Examiner*—Joseph Falk

*Attorney, Agent, or Firm*—Thomas R. Morrison

[57] ABSTRACT

A computer work station for use with a computer system includes two sections, a front section and a rear section, pivotably connected about an exterior pivot axis. The rear section includes shelves for supporting some components of the computer system, such as the CPU, display monitor, keyboard and modem. A keyboard shelf is slidably disposed within the rear section, while other shelves are fixedly mounted therewithin. A common power strip is disposed between two of the shelves of the rear section for providing a single connection of at least some of the components of the computer system to an exterior power source. The front section includes a front panel which extends substantially the entire height of the computer work station, and includes a cork strip for posting memoranda and the like thereon. The front section further includes shelves for supporting other components of the computer system, such as a printer and its associated box of paper. None of the shelves extend the complete depth of the computer work station, so that cords used to connect the various components of the computer system may be conveniently placed therebehind. The computer work station also includes fasteners for supporting such cords between the front and rear sections. The front and rear sections are shaped complementarily with respect to each other, so that, when the computer work station is in a closed position, the two sections together form a substantially enclosed object.

17 Claims, 5 Drawing Figures

COMPUTER WORK STATION

BACKGROUND OF THE INVENTION

The present invention relates to office furniture, and more particularly, to a novel and improved work station suitable for supporting and storing a system including a computer and several peripheral pieces of equipment.

Computers and their peripherals have become increasingly commonplace pieces of office equipment. A problem has arisen with regard to implementing the use of such equipment, namely that conventional office furniture is poorly adapted to deal with the growing presence of such technical devices. For example, a conventional desk has a generally flat top, and several drawers and/or shelves for the storage of traditional office materials, such as, for example, paper clips, paper, staples and the like. Such materials are conveniently stored in small compartments, and need not be accessible at all times, but rather need only be accessible on occasion, and for brief moments, such as for the retrieval of a rubber band or paper clip.

Computer systems, however, present a unique set of problems in the design of office furniture which are not readily soluble by adapting conventional furniture.

First, computer systems require an electrical power source mandating the use of heavy cords or cables leading to and from that power source. The components of a computer system include a computer and various pieces of peripheral equipment, including, for example, a printer, a display monitor, a mouse and a modem. Each such component generally requires its own connection to the power source, with some peripherals requiring additional connections to the central processing unit (CPU) of the computer or to each other, thereby leading to a rapid multiplication of the number of cords and cables required at the work station. The deployment of large numbers of cords not only results in an unsightly tangle, but in a potentially dangerous situation in which cords and other connectors may be damaged by, or cause injury to, persons passing by the work station.

Second, a computer system takes up a great deal of space. By way of example, many common printers utilize a tractor-feeder or other automatic paper-feed accessories which utilize continuous fan-fold paper, thereby mandating that a box of such paper be maintained near, and generally directly beneath, the printer to permit the smooth feeding of the paper thereto. Maintaining the printer and paper in their proper positions requires the permanent dedication of a certain amount of space to the needs of these peripherals. Such dedicated space should be relatively close to the computer itself, to minimize the amount of time necessary to commence the printing operation.

In addition, a computer operator utilizing a computer system requires space for the storage of other materials, such as computer disks or tapes, computer manuals, and the more traditional materials. Thus, there is a need for additional space, well-organized, in a compact area, for facilitating the use of computers and their peripherals.

It therefore would be advantageous to provide a new design for a computer work station which could accommodate all of the equipment and materials required for convenient use of a computer system.

The storage of a computer system is a third problem presented by the cumbersome nature of the components thereof. It is often useful to move the entire computer system, and any accompanying materials from place to place within the office conveniently, to permit ease of storage when the equipment is inactive for extended periods, as well as for ease of transportation when different computer operators must utilize the same equipment at different locations in the office.

It would thus be useful if the office furniture used to house and support the computer and its peripherals could be transported easily from place to place without the need for disassembling and reassembling the computer system each time it is moved.

Fourth, since the purchase of a computer and its peripherals represents a large capital expenditure, often several thousands of dollars, it would also be advantageous to provide a computer work station which could easily be made secure whenever the operator of the computer leaves the work station, and then just as easily be set up for work upon return of the operator.

Attempts have been made in the prior art to design computer work stations which provide some of the advantages described above, and to overcome some of the drawbacks of traditional furniture in the computerized office.

One attempt resulted in an open, stationary, work station having at least three separate shelves: one for a computer keyboard; one several inches above the keyboard shelf for a display monitor; and a third below the keyboard shelf for a printer. The shelves are generally parallel, with the keyboard shelf being the largest of the three.

The described configuration does not provide an arrangement which is readily transportable, nor does it have any security features therein. Furthermore, this work station does not provide for the convenient storage of materials used in the operation of the computer, nor for peripherals other than the printer.

A more recent computer work station, manufactured and sold by IBM under the trademark Synergetix, takes the form of a cabinet having interlocking pivoted front and rear portions. The Synergetix work station folds into itself to form a cube which may be locked in a closed position. The front portion, which extends roughly two-thirds of the way from the bottom of the cube towards the top thereof, pivots away, when opened, from the rear portion, and contains shelves upon which some peripherals and computer-related materials may be stored. The rear portion contains shelves on which a modem and CPU may be positioned. The keyboard is placed on a shelf which swings down from the remainder of the front surface (i.e. that part thereof which does not swing away from the rear portion), and the monitor is placed on top of the opened work station. The described work station allows for the secure storage of the computer and peripherals while inactive, and simultaneously allows for the convenient positioning of the components of the system.

The Synergetix work station has several drawbacks, however. First, the keyboard is stored in a location other than that from which it is used. This essential component of the computer system must be installed each time the system is to be used, and cannot be stored in or near its operational position.

Second, the cables which must run between the front and rear portions to ensure the smooth operation of the system may not be kept permanently in place. They must be disassembled each time the system is to be stored.

Each activity which must be performed to assemble and disassemble the working system is a disincentive to its use, and reduces the productivity of the employee utilizing the system at such a work station.

It is an object of the invention to provide a computer work station which overcomes these and other drawbacks of the prior art.

Another object of the invention is to provide an improved computer work station which may conveniently support and store a computer having at least one peripheral associated therewith.

Still another object of the invention is to provide an improved computer work station with sufficient space therein for storing materials used with the computer in covenient locations for ready access during use of the computer.

A further object of the invention is the provision of an improved computer work station which provides for improved security for the computer system.

A further object of the invention is to provide an improved computer work station which enables the easy transportation of the computer system without the need for disassembly thereof.

SUMMARY OF THE INVENTION

In accordance the invention herein, there is provided a computer work station for use with a computer system, comprising a desk section of inverted L-shaped configuration having a rear panel and a first support surface for supporting a first component of said computer system, an auxiliary section of L-shaped configuration having a front panel and a second support surface for supporting a second component of said computer system, and coupling means hingedly interconnecting said desk and auxiliary sections about a pivot axis for pivoting movement of said auxiliary section relative to said desk section between an open position and a closed position. The front panel and rear panel extend substantially the full height of said computer work station, and the desk and auxiliary sections have complementary shapes, so that, when the auxiliary section is in said closed position, the sections together form a substantially enclosed structure with said front and real panels constituting the front and rear walls thereof. The first and second support surfaces are so positioned that one of said support surfaces is disposed above the other thereof within said enclosed structure when the auxiliary section is in its closed position.

According to a feature of the invention, the desk section also includes a third support surface for supporting a third component of the computer system, preferably a keyboard, and means for slidably mounting the third support surface on the desk section for sliding movement toward and away from the rear panel, so that the keyboard may be slid between an extended and a retracted position.

In a preferred embodiment of the invention, the support surfaces comprise shelves which extend the width of the work station but which extend less than the full depth of the work station, these shelves being so disposed as to be spaced from the respective front and rear panels, thereby providing a space therebetween through which may pass the cables or cords which interconnect the computer system components supported on the shelves. The work station also includes a plurality of fastener elements for supporting the cables or cords which connect the first and second components of the computer system, these fastener elements being disposed in close proximity to the pivot axis which connects the desk and auxiliary sections, and in close proximity to each other, so that a relatively short section of the cables or cords extends therebetween.

According to a further feature of the invention, the auxiliary section further includes a utility shelf pivotally mounted on the end of said auxiliary section remote from the front panel for movement between an extended horizontal position and a retracted vertical position, and latching means for retaining said utility shelf in said extended position.

Briefly stated, the invention is directed to a computer work station for use with a computer system, the computer work station including two portions, a front portion and a rear portion, pivotably connected about an exterior pivot axis. The rear portion includes shelves for supporting some components of the computer system, such as the CPU, display monitor, keyboard and modem. A keyboard shelf is slidably disposed within the rear portion, while other shelves are fixedly mounted therewithin. A common power strip is disposed between two of the shelves of the rear portion for providing a single connection of at least some of the components of the computer system to an exterior power source. The front portion includes a front panel which extends substantially the entire height of the computer work station, and includes a cork strip for posting memoranda and the like thereon. The front portion further includes shelves for supporting other components of the computer system, such as a printer and its associated box of paper. None of the shelves extend the complete depth of the computer work station, so that cords used to connect the various components of the computer system may be conveniently placed therebehind. The computer work station also includes fasteners for supporting such cords between the front and rear portions. The front and rear portions are shaped complementarily with respect to each other, so that, when the computer work station is in a closed position, the two portions together form a substantially enclosed object.

Additional objects and advantages of the present invention will become apparent from the following description read in conjunction with the accompanying drawings, in which like reference numerals designate the same elements.

DESCRIPTION OF THE PREFERRED EMBODIMENT

Figure 1:
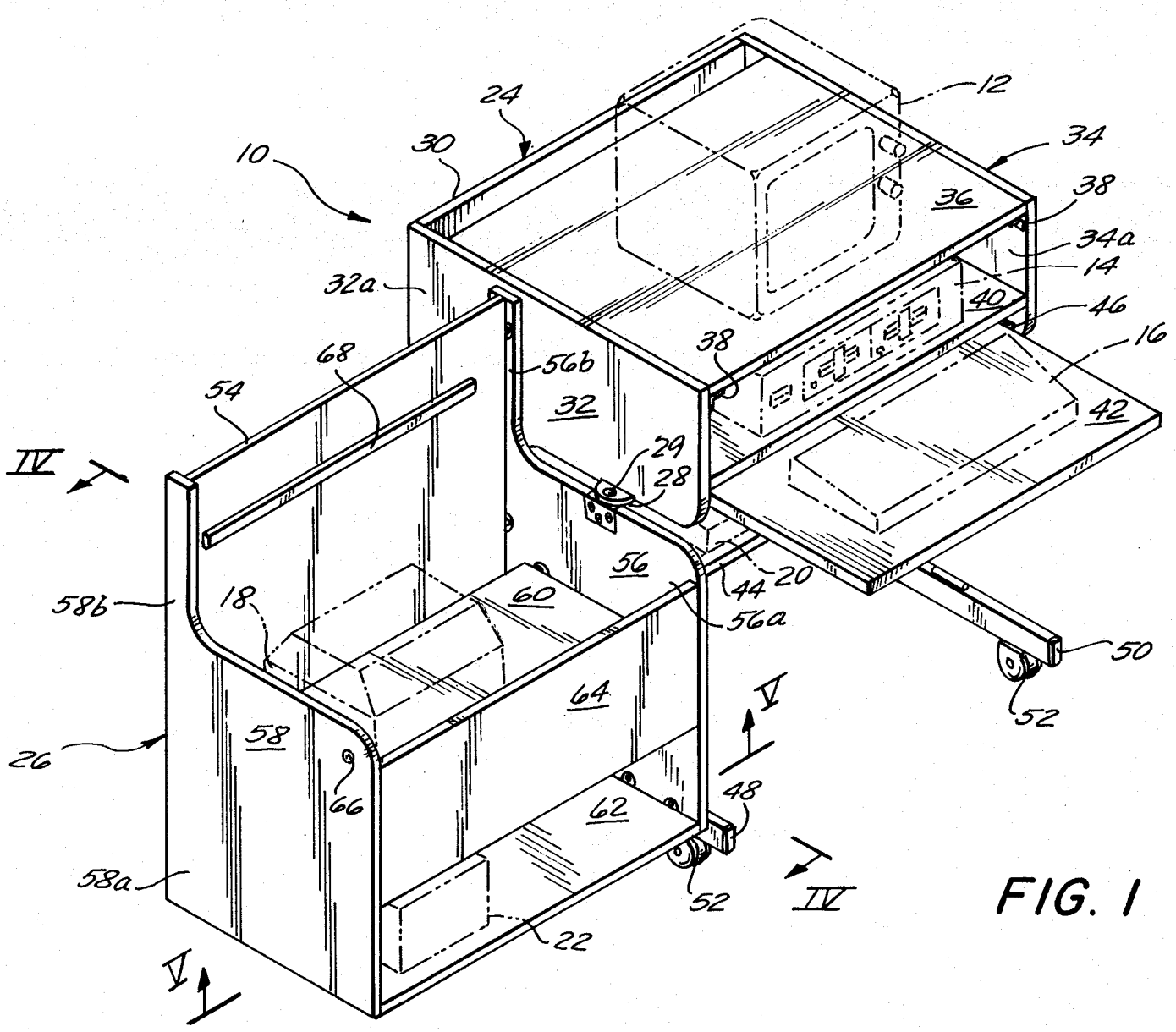
FIG. 1 is a perspective of a computer work station made in accordance with the present invention, and shown in its open position, with a computer system illustrated in broken line.

FIG. 1 illustrates a preferred embodiment of a computer work station made in accordance with the present invention, and illustrated generally at 10. A computer system, with which computer work station 10 may be used, is shown in broken line. The components of the computer system include a display monitor 12, a CPU 14, a keyboard 16, a printer 18 and a modem 20. Printer 18 is preferably associated with the usual box of fan-fold paper 22.

Computer work station 10 comprises a rear section 24 and a front section 26, joined together at a pair of exterior hinges 28. Rear section 24 may be termed a "desk section" since it is so constructed that a user may sit thereat and view the computer monitor while operating the keyboard. Front section 26 may be termed an "auxiliary section" since it is intended to contain the printer 18, box of paper 22, and other peripherals and accessories, as well as providing a convenient work-space shelf, as will be presently described. The hinges 28 enable the auxiliary section 26 to be pivoted relative to the desk section 24 between a closed position shown in FIG. 2 and an open working position shown in FIG. 1.

Figure 2:
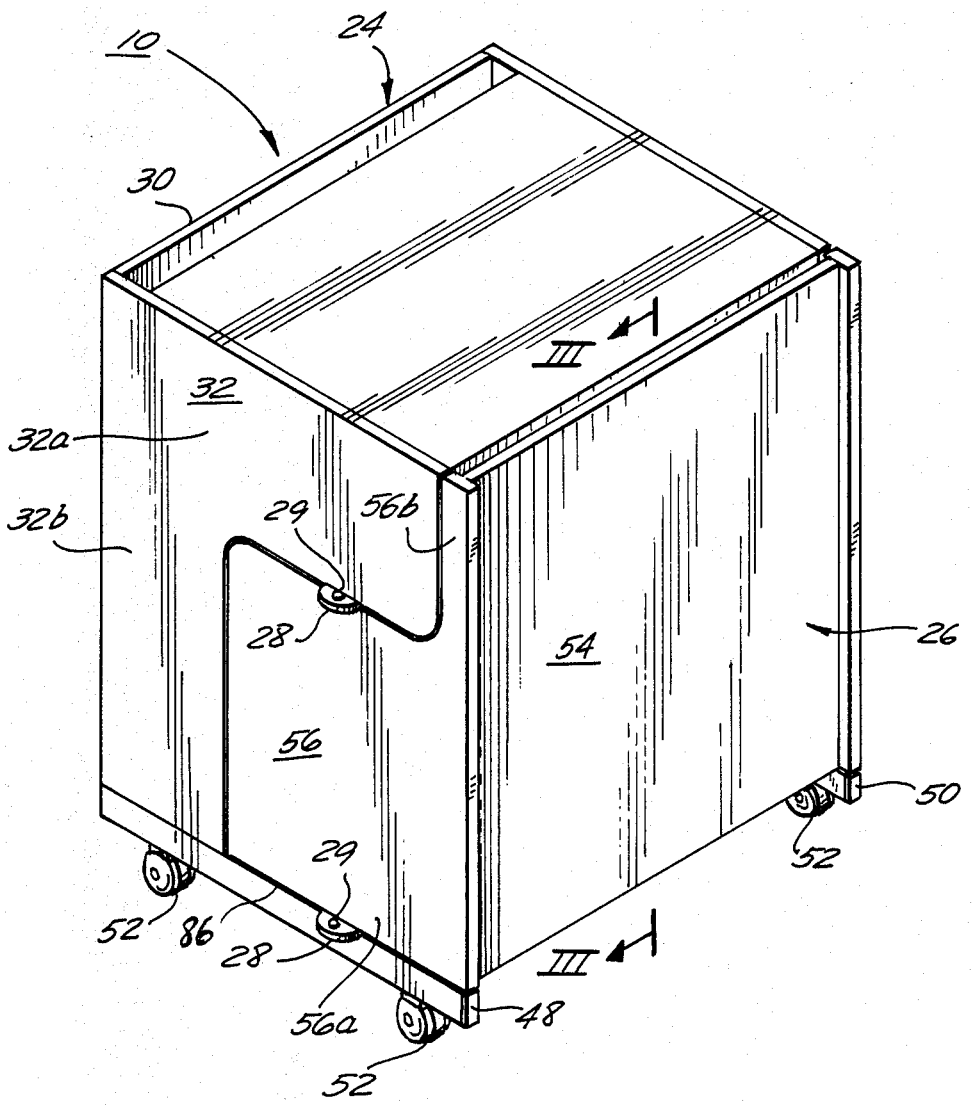
FIG. 2 is a perspective of the computer work station of FIG. 1 in closed position.

The desk section 24 comprises a rear panel 30 having a generally L-shaped left side panel 32 and a generally L-shaped right side panel 34 affixed thereto. The left side panel 32 is formed with a top portion 32*a* which extends the entire depth of the desk section 24, and a depending narrow lower portion 32*b*, as best seen in FIG. 2. The right side panel 34 is of identical size and shape, having a top portion 34*a* extending the entire depth of the desk section 24 and a depending narrow lower portion (not shown). When viewed from the right side of computer work station 10, both left side panel 32 and right side panel 34 appear as inverted "L"s. Desk section 24 further includes a top shelf 36, mounted on, and disposed between, the upper ends of left side panel 32 and right side panel 34 by a pair of mounting brackets 38.

Desk section 24 further comprises a CPU shelf 40 fixedly mounted on and between left side panel 32 and right side panel 34; a keyboard shelf 42 slidably mounted on and between left side panel 32 and right side panel 34 below CPU shelf 40; and a modem shelf 44 fixedly mounted on and between left side panel 32 and right side panel 34 below keyboard shelf 42. Keyboard shelf 42 is positioned within a pair of opposed channel tracks 46, a first of which is mounted on left side panel 32, and a second of which is mounted on right side panel 34. Keyboard shelf 42 is slid beneath CPU shelf 40 for storage when computer work station 10 is closed. When the work station is open and in use, the keyboard shelf 42 is slid outwardly to a desired extended position, as shown in FIG. 1, so that the keyboard 16 is properly positioned above the lap of the operator sitting in front of the desk section 24.

Finally, desk section 24 also includes left and right bottom leg supports or brackets 48 and 50, each affixed to the bottom of rear panel 30 and to a respective one of the left side panel 32 and right side panel 34, and each also having at least one caster 52 attached thereto.

The precise arrangement of the components of the computer system is not crucial, but it is preferred that they be arranged in the manner illustrated. As shown, display monitor 12 is positioned on top shelf 36, CPU 14 is positioned on CPU shelf 40, keyboard 16 is positioned on keyboard shelf 42 and modem 20 (partially shown) is positioned on modem shelf 44. It is preferred that computer work station 10 be approximately thirty six inches high (appx. 90 cm), for convenience of use by the operator thereof. It is also preferred that keyboard shelf 42 be positioned approximately ten inches (25 cm) below top shelf 36, as that separation has been determined to be the preferred distance between display monitor 12 and keyboard 16. The spacing and positioning of CPU shelf 40 relative to top shelf 36 and keyboard shelf 42 is less relevant, however, so long as CPU shelf 40 has sufficient clearance thereabove to accommodate most conventional CPUs. A height of six inches (16 cm) is acceptable. It is further preferred that CPU shelf 40 be positioned intermediate top shelf 36 and keyboard shelf 42, for the optimum utilization of space, and ease of use. Finally, it is also preferred that modem shelf 44 be positioned near the bottom of desk section 24, since the computer operator may not often need to adjust modem 20 manually, and it, therefore, may be kept out of the way. Modem shelf 44 may also be used to store other material, such as dictionaries, manuals and the like, which may be required by the operator of the computer system, but not on a constant basis.

Auxiliary section 26 includes a front panel 54, a left side panel 56 and a right side panel 58. Left side panel 56 and right side panel 58 each are affixed to, and extend from, front panel 54. The left side panel 56 is formed with a lower portion 56*a* which extends the entire depth of the auxiliary section 26, and an upstanding narrow upper portion 56*b*, as best seen in FIG. 2. The right side panel 58 is of identical size and shape, having a lower portion 58*a* extending the entire depth of the auxiliary section 26 and an upstanding narrow upper portion 58*b*, as shown in FIG. 1. When viewed from the right side of computer work station 10, both left side panel 56 and right side panel 58 are substantially L-shaped. As shown most clearly in FIG. 2, left side panel 56 of auxiliary section 26 is shaped complementarily with respect to left side panel 32 of desk section 24, so that left side panel 32 and left side panel 56 together form a rectangle, when computer work station 10 is in its closed position. Right side panel 58 is similarly shaped with respect to right side panel 34, and so when computer work station 10 is closed, it forms a substantially enclosed object of cube shape.

The pair of exterior hinges 28 are positioned with their pivot axes 29 on the exterior of computer work station 10. The upper hinge 28 interconnects the lower edge of top portion 32*a* of left side panel 32 with the top edge of the lower portion 56*a* of left side panel 56. This top hinge is substantially centered on said top portion 32*a* and lower portion 56*a*. The lower hinge 28 connects the lower edge left side panel 56 of auxiliary section 26 to the left bottom leg 48. The hinges 28 are vertically aligned, and thus the pivoting axis of auxiliary section 26 is exterior to computer work station 10. This placement of pair of exterior hinges 28 ensures that the pivoting movement of auxiliary section 26, as it is moved into its open working position, is kept to a minimum. When computer work station 10 is to be used, auxiliary section 26 is swung about pair of exterior hinges 28, away from desk section 24, to its illustrated open position. The placement of the pair of exterior hinges 28 on the exterior of left side panel 32 means that when auxiliary section 26 is pivoted into its completely open position, left side panel 56 contacts left side panel 32, and left side panel 32 acts as a stop for the movement of auxiliary section 26.

When inactive, computer work station 10 is kept in its closed position (FIG. 2). The generally enclosed exterior of computer work station 10 acts as a security feature, since none of the valuable components of the computer system are in the open. While closed, it is preferred that computer work station 10 be secured by a lock 66 (FIG. 1).

Returning now to FIG. 1, auxiliary section 26 further includes a printer shelf 60, a paper shelf 62 and a utility shelf 64. Both printer shelf 60 and paper shelf 62 are fixedly disposed between left side panel 56 and right side panel 58, with printer shelf 60 disposed above paper shelf 62. Printer shelf 60 and paper shelf 62 do not extend along the entire depth of auxiliary section 26, but rather leave a space between their respective front ends and front panel 54. This space provides clearance, so that cables, paper and the like may run from shelf to shelf, or from desk section 24 to auxiliary section 26, as described in greater detail below. Utility shelf 64 is hingedly mounted by pivots 65 (FIG. 3) between left side panel 56 and right side panel 58. A cork strip 68 is disposed on an the interior surface of the upper end of front panel 54, from which papers, memoranda and the like (not shown) may be suspended as desired.

Figure 3:
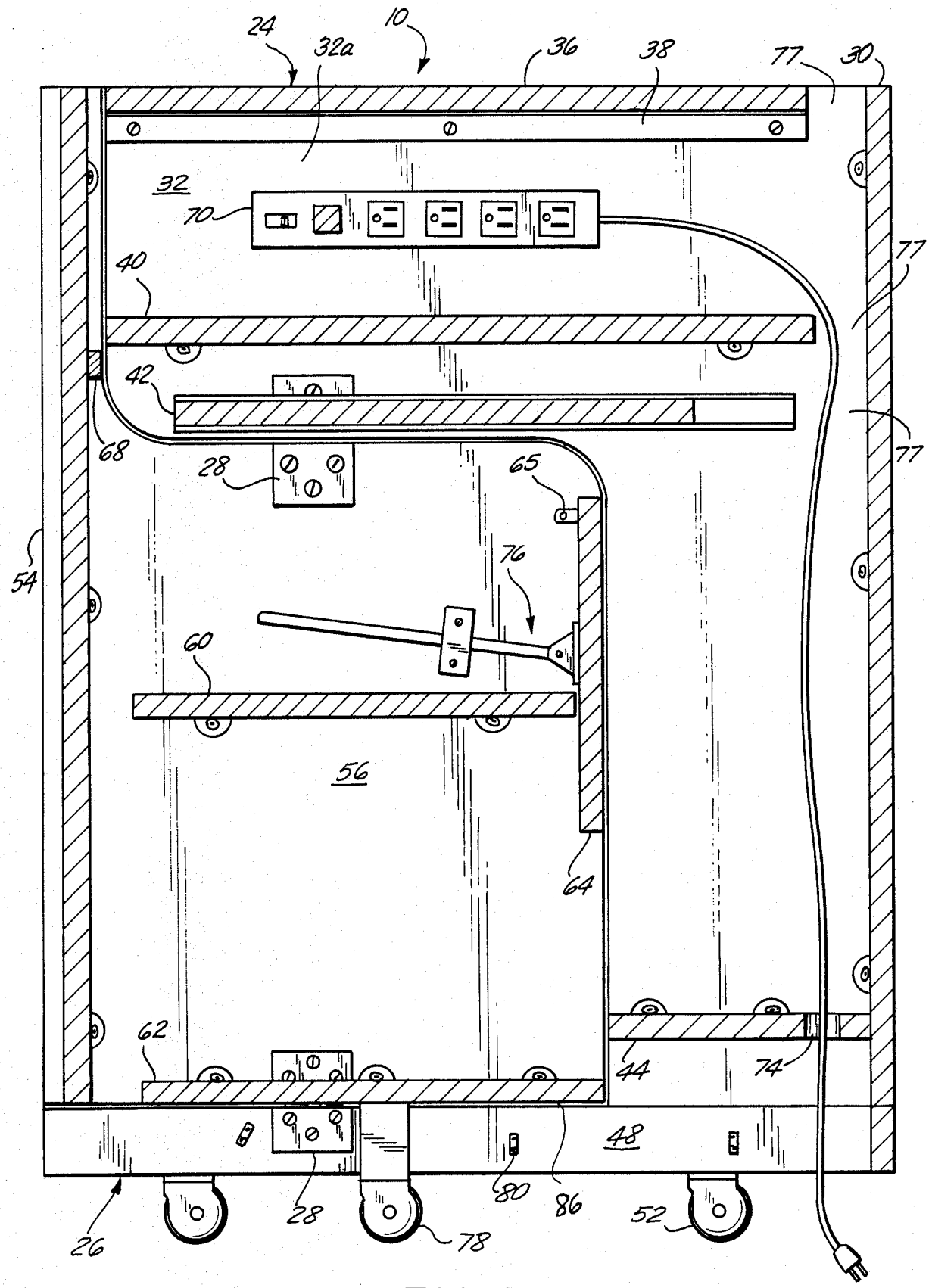
FIG. 3 is a cross-section of the computer work station of FIG. 1, taken along the line III—III of FIG. 2.

As shown in FIG. 3, computer work station 10 further includes a conventional power strip 70 disposed on an interior surface of left side panel 32, between top shelf 36 and CPU shelf 40. Power strip 70 includes a line cord 72 which extends from an end thereof through a hole 74 in modem shelf 44 to the exterior of computer work station 10 for connection to a power source (not shown). All power connections for the computer system may be made at power strip 70, and so, when movement of computer work station 10 is desired, only one power connection need be broken.

FIG. 3 also illustrates a latch arrangement 76 which secures utility shelf 64 in an extended position (not shown) in which shelf 64 extends horizontally and projects outwardly from the free ends of side panels 56 and 58. FIG. 3 also illustrates certain aspects of the configuration of computer work station 10 not otherwise apparent in the Drawing. Specifically, top shelf 36, CPU shelf 40, and keyboard shelf 42 do not extend all the way to rear panel 30, leaving a space 77 between each shelf 36, 40 and 42 and rear panel 30. As is the case with the respective depths of printer shelf 60 and paper shelf 62, the relative shortness of these shelves allows the interior passage of various cords such as, for example, cord 72, as well as other cables and connectors (not shown) needed for the computer system. Since all of the connections between the components of a conventional computer system are made at the rear thereof, spaces 77 enable the routing of the required connections therebehind, as described.

Also depicted is a caster 78, affixed to the bottom of paper shelf 62, on which caster 78 auxiliary section 26 may ride when pivoted to or from its closed position.

Finally, FIG. 3 also illustrates the positioning of several fastener elements 80, the operation of which will be discussed in greater detail below.

CPU 14, printer 18, modem 20 and box of paper 22 are kept in their operational positions while computer work station 10 is closed, and so are ready for use when auxiliary section 26 swings open. For security reasons, display monitor 12 may not be kept in its operative position when closed, but can be later placed on top shelf 36, once computer work station 10 is opened. Keyboard 16 is kept in its operative position on keyboard shelf 42 while keyboard shelf 42 is slid beneath CPU shelf 40 for storage. The construction of computer work station 10 allows for storage of keyboard 16 in its operative position (relative to keyboard shelf 42), while maintaining the required connection between keyboard 16 and CPU 14.

A major impediment to the efficient setup of a computer work station is the usual required pre-operational coupling of all the various components thereof. With known work stations, such as the above-described Synergetix work station by IBM, there is a problem in maintaining the connections between the two halves thereof when the work station is opened and closed. Thus where the CPU is contained in one of the halves and the printer or other component or peripheral is located in the other of the halves, it has been found impossible to interconnect the components in the two halves by permanent connector couplings. Long lengths of cable or cords would be required to interconnect the separated components in the two halves, and the cables or cords would either be subjected to considerable strain when the halves were opened or would sag and protrude when the halves were brought together, preventing complete closure of the work station.

Figure 4:
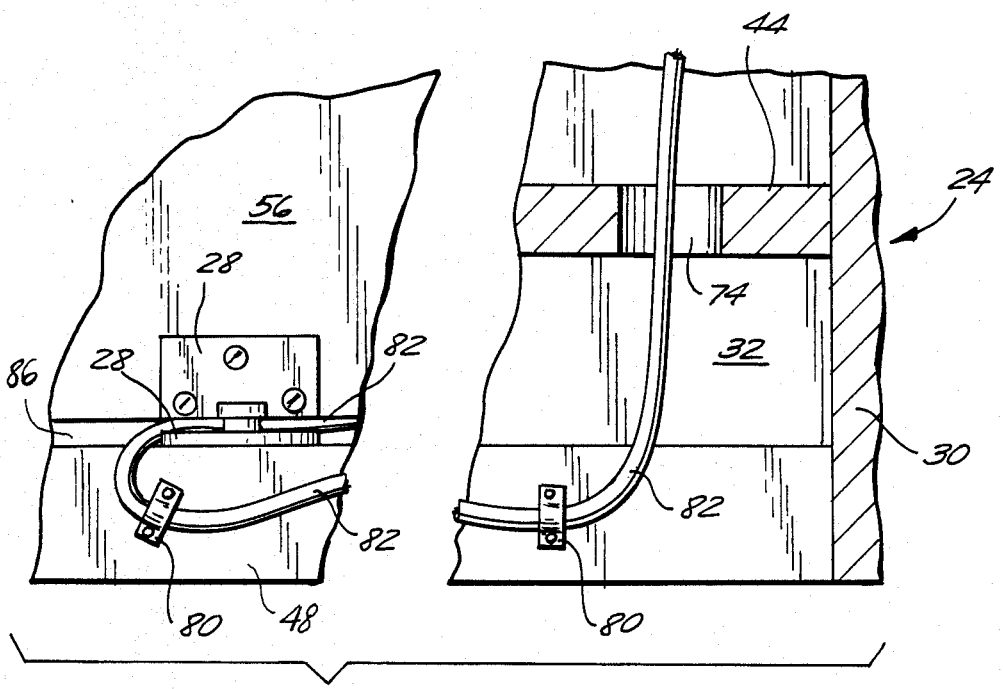
FIG. 4 is an enlarged detail of a portion of the computer work station of FIG. 1, taken along the line IV—IV of FIG. 1.

As shown in FIG. 4, this difficulty is overcome in the present embodiment by the unique placement of the hinges 28 and by the use of fasteners 80, and running cables or cords, such as a cord 82, through fasteners 80 and between left side panel 32 of desk section 24 and left side panel 56 of auxiliary section 26.

Figure 5:
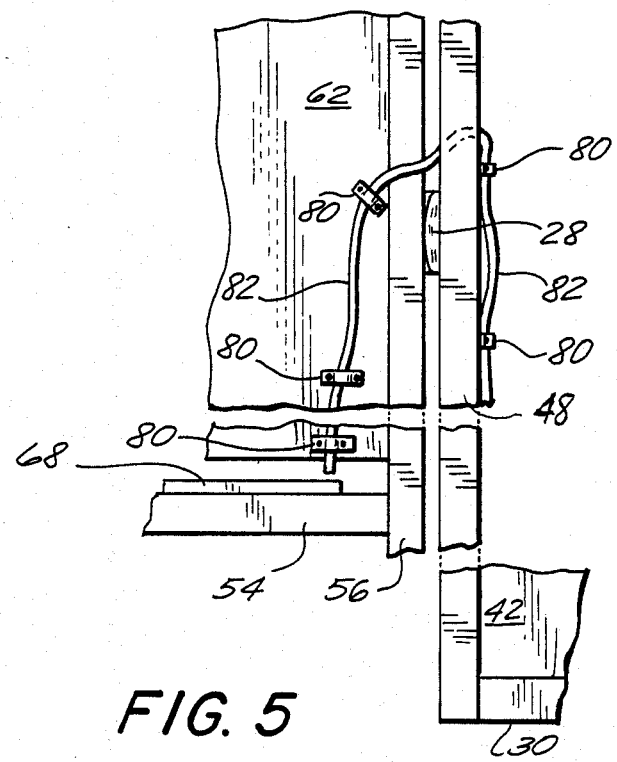
FIG. 5 is an enlarged detail of a second portion of the computer work station of FIG. 1, taken along the line V—V of FIG. 1.

One fastener 80 is positioned on left bottom leg 48 in relatively close proximity to the lower of the pair of exterior hinges 28, and there secures a first section of cord 82. Turning now also to FIG. 5, a second fastener 80 is positioned on the underside of paper shelf 62, also in relatively close proximity to the lower of pair of exterior hinges 28, there securing a second section of cord 82. The proximity of the two fasteners 80, both to each other and to the lower exterior hinge 28, ensures that there is a very short amount of cord 82 which bridges left side panel 32 and left side panel 56, thereby allowing only a small amount of play between the two secured sections. In this manner, there is little likelihood that cord 82 will prevent the easy opening and closing of computer work station 10.

The mounting of the cord 82 in the manner described above is made possible by providing sufficient vertical space between the bottom edge of the front auxiliary section 26 and the upper surface of left bottom leg support 48 so that the cord 82 may pass freely therethrough. For this purpose, the external hinge 28 is sized to support the front auxiliary section 26 so that the bottom edge of the left front panel 56 is spaced approximately one-half inch above the upper surface of the left bottom leg support 48, this spacing being shown at 86 in FIGS. 2, 3 and 4. The spacing 86 enables the cord 82 to extend from the front auxiliary section 26 to the rear desk section 24 without being compressed or interfering with the opening and closing movement of the front and rear sections.

Thus, connection between all components of the computer system positioned on both desk section 24 and auxiliary section 26 may be permanently maintained, while greatly facilitating the setup of the computer system.

When the work station 10 is to be used, the auxiliary section 26 is swung away from the desk section 24 to expose the interiors of both sections. The auxiliary section may be brought to its fully open position shown in FIG. 1 in which it is parallel to the desk section 24, or to any intermediate position angularly extending from the desk section for closer and more convenient access to the extended utility shelf 64 by the operator sitting before the desk section 24. In any of these positions, switching on the power strip 70 results in immediate energization of the entire computer system including the CPU, printer, monitor, and other components and peripherals. The keyboard shelf 42 is extended to bring the keyboard 16 to a selected position, and elevating the utility shelf 64 enables the placement of books or other papers for referral or copying on the keyboard while the operator is observing the monitor 12.

While preferred embodiments of the invention have been shown and described herein, it will be obvious that numerous omissions, changes and additions may be made in such embodiments without departing from the spirit and scope of the invention as defined in the appended claims.

What is claimed is:

1. A computer work station for use with a computer system, comprising:

a desk section having first and second side panels, a rear panel, and a first support surface between said first and second side panels for supporting a first component of said computer system;

said first and second side panels being solid and having a substantially inverted L shape;

said rear panel being substantially solid;

an auxiliary section having third and fourth side panels, a front panel and a second support surface for supporting a second component of said computer system;

said third and fourth side panels being solid and having a substantially L shape, said L shape having a substantially complementary shape to said inverted L shape;

said front panel being substantially solid;

coupling means hingedly interconnecting said desk and auxiliary sections about a vertically disposed pivot axis for pivoting horizontal movement of said auxiliary section relative to said desk section between an open position and a closed position;

said front panel and said rear panel extending substantially a full height of said computer work station;

said complementary shape, when said auxiliary section is in said closed position, permitting said sections to fit together to form a substantially enclosed structure with said front and rear panels constituting the front and rear closed walls thereof, said first and third end panels forming a first side thereof and said second and fourth end panels forming a second side thereof; and one of said first and second support surfaces being disposed above the other thereof within said enclosed structure when said auxiliary section is in said closed position.

2. A computer work station according to claim 1, wherein said desk section further includes a third support surface for supporting a third component of said computer system, and means slidably mounting said third surface on said desk section for horizontal sliding movement toward and away from said rear panel.

3. A computer work station according to claim 1, wherein at least one of said first and support surfaces is a shelf extending less than a full depth of said computer work station.

4. A computer work station according to claim 3, wherein said shelf is spaced from the panel of the respective section to provide a space of sufficient size to permit passage therethrough of an electrical connecting means for connecting said first and second components of said computer system.

5. A computer work station according to claim 4, which further comprises connector supporting means including first and second fastener elements for supporting a portion of said electrical connecting means, said fastener elements being disposed in close proximity to said pivot axis.

6. A computer work station according to claim 5, wherein said first and second fastener elements are disposed in relatively close proximity to one another, so that a relatively short section of said electrical connector means extends between said first and second fasteners.

7. A computer work station according to claim 1, wherein said desk section further comprises a top wall extending the width of said desk section and constituting a third support surface for supporting a third component of said computer system.

8. A computer work station according to claim 1, wherein said auxiliary section further includes a utility shelf pivotally mounted on the end of said auxiliary section remote from said front panel for movement between an extended horizontal position and a retracted vertical position, and latching means for retaining said utility shelf in said extended position.

9. A computer work station according to claim 1, wherein said pivot axis is on the exterior of said computer work station.

10. A computer work station according to claim 1, which further comprises connector supporting means including a plurality of fastener elements for supporting an electrical connector means for connecting said first and second components of said computer system, said fastener elements being disposed in close proximity to said pivot axis.

11. A computer work station according to claim 10, wherein said connector supporting means includes a first fastener element disposed fixedly relative to said first support surface, and a second fastener element disposed fixedly relative to said second support surface, each of said first and second fastener elements being disposed in close proximity to said pivot axis.

12. A computer work station according to claim 11, wherein said first and second fastener elements are disposed in relatively close proximity to one another, so that a relatively short section of said electrical connector means extends between said first and second fasteners.

13. A computer work station according to claim 12, wherein said desk section includes a bottom leg extending perpendicularly from said rear panel, said first fastener element being mounted on said bottom leg, and wherein said said bottom leg is spaced above the bottom surface of said auxiliary section to provide a space of sufficient size to permit passage therethrough of said electrical connector means.

14. A computer work station for use with a computer system of a type including a display monitor, a CPU and a keyboard, comprising:

a desk section, having a substantially solid rear panel, and first and second substantially solid side panels each affixed to said rear panel and projecting perpendicularly therefrom;

an auxiliary section, having a substantially solid front panel, and third and fourth substantially solid side panels each affixed to said front panel and projecting perpendicularly therefrom;

said first and third side panels having complementary shapes, and together forming a first rectangle;

said second and fourth side panels also having complementary shapes, and together forming a second rectangle;

said first side panel and said third side panel being joined at a pair of exterior hinges having a vertical axis;

said front panel extending substantially a full height of said computer work station;

said desk section further including a top shelf, a CPU shelf and a keyboard shelf;

said top shelf and said CPU shelf being fixedly mounted on said desk section, and each being spaced from said rear panel whereby a space is provided for running cables between equipment in said computer work station;

a track mounted on said first side panel and said third panel section of said desk section; and means for slidably mounting said keyboard shelf within said track for movement between a retracted position within said desk section and an extended position projecting outwardly from said desk section.

15. A computer work station according to claim 14, wherein said top shelf is sized to support said monitor, said CPU shelf being spaced below said top shelf, and said keyboard shelf being spaced below said CPU shelf.

16. A computer work station according to claim 15, wherein said computer system also includes a printer, and wherein said auxiliary section includes a printer support shelf, a printer supply shelf spaced beneath said printer support shelf, and a utility shelf pivotally connected between said third and fourth side panels of said auxiliary section above said printer support shelf for movement between an extended horizontal position and a retracted vertical position.

17. A computer work station according to claim 16, wherein said auxiliary section also includes a cork strip affixed to an interior surface of said front panel.

* * * * *